United States Patent [19]

Newby

[11] Patent Number: 4,810,337

[45] Date of Patent: Mar. 7, 1989

[54] METHOD OF TREATING A CHROMIUM ELECTROPLATING BATH WHICH CONTAINS AN ALKYL SULFONIC ACID TO PREVENT HEAVY LEAD DIOXIDE SCALE BUILD-UP ON LEAD OR LEAD ALLOY ANODES USED THEREIN

[75] Inventor: Kenneth Newby, Berkeley Heights, N.J.

[73] Assignee: M&T Chemicals Inc., Woodbridge, N.J.

[21] Appl. No.: 180,503

[22] Filed: Apr. 12, 1988

[51] Int. Cl.[4] ..... C25D 3/10

[52] U.S. Cl. ..... 204/51

[58] Field of Search ..... 204/51, 130, 140

[56] References Cited

U.S. PATENT DOCUMENTS 2,547,120 4/1951 Herwig ..... 204/51

4,588,481 5/1986 Chessin et al. ..... 204/51

*Primary Examiner*—G. L. Kaplan

*Attorney, Agent, or Firm*—S. A. Marcus

[57] ABSTRACT

A method of treating a chromium electroplating bath which contains an alkyl sulfonic acid to prevent heavy scale build-up of lead dioxide on lead or lead alloy anodes used therein is described herein. The method involves applying a voltage across the electrodes in said bath which is greater than the normal operating voltage during electrodeposition of chromium.

7 Claims, No Drawings

METHOD OF TREATING A CHROMIUM ELECTROPLATING BATH WHICH CONTAINS AN ALKYL SULFONIC ACID TO PREVENT HEAVY LEAD DIOXIDE SCALE BUILD-UP ON LEAD OR LEAD ALLOY ANODES USED THEREIN

BACKGROUND OF THE INVENTION

1. Field of the Invention

This invention relates to eleotrodeposition of chromium for functional purposes on basic metals from hexavalent chromium plating baths containing an alkyl sulfonic acid, and, more particularly, it is concerned with a method of treating a chromium electroplating bath which contains an alkyl sulfonic acid to prevent heavy lead dioxide scale build-up on lead or lead alloy anodes used therein.

2. Description of the Prior Art

Hexavalent chromium electroplating baths containing an alkyl sulfonic acid produce non-iridescent, adherent, bright chromium deposits at high cathode efficiencies. Such baths, are described by Chessin and Newby in U.S. Pat. No. 4,588,481. They generally contain chromic acid as the source of chromium and sulfate as a catalyst and almost invariably employ lead or a lead alloy as the anode. However, in the presence of the alkyl sulfonic acid additive, it is often observed that such baths promote a rapid build-up of heavy lead dioxide scale on the anode, which is detrimental to the process, for example, a scale deposit of 150" to 174" in 2–3 days of electroplating may be experienced with these baths. When such scale is formed, it is necessary to interrupt the operation to clean the anodes. Furthermore, the anode life is significantly shortened when scale is found.

Accordingly, it is an object of the present invention to provide a method of treating a chromium electroplating bath which contains an alkyl sulfonic acid to prevent heavy scale build-up on lead or lead alloy anodes used therein.

A specific object of the invention is to provide a method of treating a chromium electroplating bath, which contains chromic acid, sulfate and methane sulfonic acid, to prevent heavy formation of lead dioxide on lead or lead alloy anodes used therein.

These and other objects and features of the invention will be made apparent from the following more particular description of the invention.

SUMMARY OF THE INVENTION

What is described herein is a method of treating a chromium electroplating bath which contains an alkyl sulfonic acid to prevent heavy scale build-up of lead dioxide on lead or lead alloy anodes used therein. The method involves applying a voltage across the electrodes in said bath which is greater than the normal operating voltage used during electrodeposition of chromium.

Typically, the applied voltage is greater than 2 volts, as measured between the anode and a chromium reference electrode, and preferably about 4.5 to 6.5 volts. This voltage is applied for a period of at least an hour, preferably from several hours to 60 hours.

DETAILED DESCRIPTION OF THE INVENTION

The chromium electroplating system herein includes:

(a) a lead or lead alloy anode;

(b) a cathode; e.g. a basis electrode;

(c) a hexavalent chromium electroplating bath including:

(i) a source of chromium; e.g. chromic acid, in an amount of 100–450 g/l;

(ii) a source of sulfate ion; e.g. sodium sulfate, in an amount of 1–5 g/l; and (iii) an alkyl sulfonic acid, where the S/C ratio is $\geqq \frac{1}{3}$, e.g. methane sulfonic acid.

The method of the invention comprises subjecting the chromium electroplating system to electrolytic anodic oxidation at a voltage in excess of the normal voltage used for electrodeposition of chromium therefrom, thereby to condition the bath so that substantially no scale build-up on the anode is formed.

The invention will now be illustrated by reference to the following example.

EXAMPLE

A hexavalent chromium electroplating bath was prepared using 100–450 g/l chromic acid, 1–5 g/l sulfate (sodium sulfate) and 1–18 g/l methane sulfonic acid as for example, (Pennwalt Corp. #1752, Phila. Pa.). Upon normal electrodeposition of chromium from this bath, at about 2 volts, using lead alloy anodes, e.g. 15% Sn—Pb anodes, a scale build-up of 150" to 174" of lead dioxide was observed after 2–3 days of plating.

Thereupon, $\frac{2}{3}$ of the anodes were removed from the bath and the remaining anodes were spaced out evenly. Dummy cathodes having a large surface area then were placed close to the remaining anodes. The rectifier then was set at about 11–12 volts. A voltmeter was used to measure the voltage between the anode and a chromium plated reference electrode placed in the bath within about two inches of the anode. The measured voltage was 5.5–6.5 volts. The anodic electrolytic process then was allowed to proceed for 8 hours.

Electroplating of chromium from the thus-treated bath then was resumed under normal operating conditions using lead alloy anodes. No scale build-up was observed on the anodes after a week of electroplating.

While the mechanism of action of the electrolytic oxidation treatment of the invention is not completely understood at present, it is believed that it removes impurities in the commercial methane sulfonic acid which contribute to scale build-up on the anode. Accordingly, an alternative procedure to the electrolytic oxidation described herein is a chemical oxidation using an oxidizing agent having an oxidation potential greater than chromic acid itself; e.g. permanganate or persulfate ions.

I claim:

1. In the method of electroplating chromium onto a cathode from an electroplating bath containing chromic acid, sulfate and an alkyl sulfonic acid, which bath may form a deleterious lead dioxide scale on lead or lead alloy anodes used therein during normal electrolytic deposition of chromium onto a basis cathode at the operating voltage of the electrodeposition, the improvement which comprises pretreating the bath by applying a voltage across the electrodes in said bath which is greater than said operating voltage for a period of time sufficient to condition the bath so that said scale build-up does not occur during electrodeposition.

2. A method according to claim 1 wherein said applied voltage is greater than 2 volts as measured between said anode and a chromium reference electrode.

3. A method according to claim 2 wherein said applied voltage is about 4.5–6.5 volts.

4. A method according to claim 1 wherein said applied voltage is present for period of from 1–60 hours.

5. A method according to claim 1 wherein said bath contains chromic acid, sulfate and methane sulfonic acid present in amounts of 100–450 g/l, 1–5 g/l and 1–18 g/l, respectfully.

6. A method according to claim 1 wherein said chromic acid is present at a concentration of about 2.5 M and the operating temperature of the bath is about 140° F.

7. A method according to claim 1 wherein said treatment reduces lead dioxide scale build-up to substantially less than a ⅛" thickness even after 3 days of operation of said bath.

* * * * *